US007585147B2

(12) United States Patent
Yonehara

(10) Patent No.: US 7,585,147 B2
(45) Date of Patent: Sep. 8, 2009

(54) PRESSURIZING CENTRIFUGAL PUMP

(75) Inventor: Ryoichi Yonehara, Shimane (JP)

(73) Assignee: Yonehara Giken Co., Ltd., Shimane (JP)

( * ) Notice: Subject to any disclaimer, the term of this patent is extended or adjusted under 35 U.S.C. 154(b) by 451 days.

(21) Appl. No.: 10/599,083

(22) PCT Filed: Mar. 16, 2005

(86) PCT No.: PCT/JP2005/004615

§ 371 (c)(1),
(2), (4) Date: Dec. 19, 2006

(87) PCT Pub. No.: WO2005/098239

PCT Pub. Date: Oct. 20, 2005

(65) Prior Publication Data

US 2007/0196207 A1 Aug. 23, 2007

(30) Foreign Application Priority Data

Mar. 31, 2004 (JP) ..... 2004-102916

(51) Int. Cl.
*F04D 29/46* (2006.01)
*F04D 5/00* (2006.01)

(52) U.S. Cl. ..... 415/29; 415/55.1

(58) Field of Classification Search ..... 415/26, 415/29, 49, 55.1, 55.4, 55.8; 416/27, 42, 416/61, 159

See application file for complete search history.

(56) References Cited

U.S. PATENT DOCUMENTS 1,619,286 A * 3/1927 Burks ..... 415/55.1

(Continued)

FOREIGN PATENT DOCUMENTS

JP 2574653 10/1996

(Continued)

OTHER PUBLICATIONS

English Language Abstract of JP 2004-060470.

(Continued)

*Primary Examiner*—Igor Kershteyn
(74) *Attorney, Agent, or Firm*—Greenblum & Bernstein, PLC

(57) ABSTRACT

A pressurizing centrifugal pump has a blade, which protrudes backwardly inclined in a radial direction from a blade plate and a boss portion and is provided with a blade forward inclination angle and a blade outer forward inclination angle. Thereby, the blade takes in fluid from a pressure chamber into a blade chamber, and discharges the fluid while preventing the fluid in the blade chamber from leaking and moving to a side. The pressurizing centrifugal pump has a drum-shaped case 4 provided with an inlet 2 and an outlet 3, wherein a pressure portion 16 is provided opposite to a blade 19 of an impeller 5, the pressure portion 16 including a pressure surface 36 that forms a pressure chamber 33 and a pressure partition wall 35. From a plain view, a blade surface 5*a* of the blade 19 is provided protruding from the blade plate 26 having a gentle blade forward inclination angle θ. A blade outer surface 5*b*, which is an outer portion from a mid-portion of the blade surface 5*a*, has a bent shape having a blade outer forward inclination angle α, which is steeper than the blade forward inclination angle θ.

9 Claims, 11 Drawing Sheets

U.S. PATENT DOCUMENTS

| | | | | |
|---|---|---|---|---|
| 3,392,675 | A * | 7/1968 | Taylor | 415/55.4 |
| 3,871,797 | A * | 3/1975 | Igarashi et al. | 417/423.3 |
| 5,458,816 | A | 10/1995 | Ebner et al. | |
| 7,121,786 | B2 * | 10/2006 | Yonehara | 415/29 |
| 7,267,524 | B2 * | 9/2007 | Yu | 415/55.1 |

FOREIGN PATENT DOCUMENTS

| | | |
|---|---|---|
| JP | 2002-089477 | 3/2002 |
| JP | 2004-060470 | 2/2004 |

OTHER PUBLICATIONS

English Language Abstract of JP 2002-089477.
English Language Abstract of JP 2574653.

* cited by examiner

PRESSURIZING CENTRIFUGAL PUMP

TECHNICAL FIELD

The present invention relates to a pressurizing centrifugal pump that rotates an impeller in a pump case so as to suck and discharge liquid and the like.

BACKGROUND TECHNOLOGY

A conventional pressurizing centrifugal pump, which sucks, pressures, and discharges fluid, such as water, oil, air, and the like, is publicly known, as disclosed in Related Art Document 1 related to the applicant's proposal.

The pressurizing centrifugal pump has a drum-shaped case provided with an inlet and an outlet, wherein an impeller is provided opposite to a pressure portion. The impeller is provided with blades protruding radially from a side surface thereof. The pressure portion is provided with a pressure surface that forms a pressure chamber converging from the inlet side to the outlet side; and a pressure partition wall that is provided proximate to a side surface of the blades and that prevents leakage of fluid in blade chambers. The pressurizing centrifugal pump sucks the fluid from the inlet, pressures the fluid in a pump chamber that includes the impeller and the pressure portion, and discharges the fluid from the outlet.

[Related Art Document 1] Japanese Patent Laid-open Publication No. 2004-60470

DISCLOSURE OF THE INVENTION

Problems to be Solved by the Invention

In the pressurizing centrifugal pump disclosed in above-mentioned Related Art Document 1, the blades, which protrude radially from a boss portion on a side surface of a blade plate, are provided with a blade forward inclination angle (an intake angle). Thus, the pump has an advantage where a blade outer end that moves ahead facilitates intake of the fluid from the pressure chamber side into the blade chambers. The blades having a planar surface and only provided with the blade forward inclination angle, however, pressure the fluid taken into the blade chambers, while allowing leakage and movement of the fluid to the side. Thus, the pump has a disadvantage that causes severe turbulence at a boundary between a side surface of the impeller and the pressure chamber, thereby deteriorating pumping efficiency.

In the above-described pump, a second pressure surface, which is provided from a pressure surface for direction change of the pressure surface to a pressure end portion at an end portion of the pressure chamber, has an inclined surface. The fluid is thus suddenly pressured by the blades and the inclined second pressure surface, when discharging from the outlet provided opposite to the second pressure surface. Thus, the pump has a disadvantage that tends to cause cavitation due to the pressure convergence and severe turbulence in the pressure end portion.

Further, when externally supplied air is mixed into the fluid and discharged in a form of fine bubbles, the bubbles do not move smoothly from the second pressure surface, where the pressure is applied rapidly, to the outlet, thus causing noise stemming from the accumulated bubbles moving in the pump chamber, discontinuous discharge of the bubbles, and the like, and declining the pumping efficiency.

Ways for Solving the Problem

To address the above-described problems, a pressurizing centrifugal pump according to the present invention first has a pump chamber 9 in a drum-shaped case 4 provided with an inlet 2 and an outlet 3, wherein an impeller 5 is provided opposite to a pressure portion 16. The impeller 5 is provided with a plurality of blades 19 that have a sweepback angle in a rotation direction and that protrude radially from a boss portion 27*a* on a side surface of a blade plate 26. The pressure portion 16 is provided with a pressure surface 36 that faces the blades 19 and that forms a pressure chamber 33 converging from the inlet 2 side to the outlet 3 side; and a pressure partition wall 35 that is provided proximate to a side surface of the blades 19 and that prevents leakage of fluid in blade chambers 27. From a plain view, a blade surface 5*a* of the blade 19 is provided protruding from the blade plate 26 having a gentle blade forward inclination angle $\theta$. A blade outer surface 5*b*, which is an outer portion from a mid-portion of the blade surface 5*a*, has a bent shape having a blade outer forward inclination angle $\alpha$, which is steeper than the blade forward inclination angle $\theta$.

Second, the blade outer surface 5*b* has a width that is wider toward an outer periphery side of the impeller 5 than the boss portion 27*a* side thereof, and has a bent shape provided on the blade surface 5*a*.

Third, a thickness of an outer end of the blade 19 includes a flat surface 5*c* and an inclined surface 5*e*. The flat surface 5*c* is provided continuing from the blade outer surface 5*b* side and proximate in parallel to the pressure partition wall 35. The inclined surface 5*e* having a chamfered shape is provided extending from the flat surface 5*c* to a blade rear surface 5*d*.

Fourth, a second pressure surface 36*a*, which is provided extending from a pressure end portion 37 provided on the pressure partition wall 35 at an end portion of the pressure chamber 33 and is positioned opposite to the outlet 3, includes a flat surface 40 and a curved surface 41. The flat surface 40 is connected to the pressure surface 36 and is provided in parallel with an outer end rotation trajectory of the blade 19. The curved surface 41 connects the flat surface 40 and the pressure end portion 37.

Fifth, a length of the pressure end portion 37 includes an outer pressure end portion 37*a* and an inner pressure end portion 37*b*. The outer pressure end portion 37*a* has about a half of a length of the blade 19 and is provided in substantially a radius direction. The inner pressure portion 37*b* is provided in a tangential direction from substantially a front side base portion of the second pressure surface 36*a*.

Effect of the Invention

The pressurizing centrifugal pump of the present invention that has the above-described structure provides advantages described below.

The blade, which protrudes backwardly inclined in a radial direction from the blade plate and the boss portion, has a bent shape provided with the gentle blade forward inclination angle and, from the mid-portion of the blade, with the blade outer forward inclination angle steeper than the blade forward inclination angle. Thereby, the blade outer surface, which moves ahead as positioned on the outer portion of the blade surface, surely takes in the fluid into the blade chamber from the pressure chamber. At the same time, the blade outer surface prevents the fluid from leaking and moving to the side and provides directivity in a discharge direction so as to efficiently discharge the fluid.

The blade outer surface has the width wider toward the outer periphery side than the boss portion side, and the blade surface has a bent shape. Thereby, the blade outer surface prevents the blade from bending on a blade base portion side, and allows smooth inflow of the fluid without reducing a fluid capacity on the blade base portion side in the blade chamber.

Further, the blade outer surface ensures intake and retention of the fluid in accordance with a blade spacing that allows a large fluid capacity in the blade chamber.

The thickness of the outer end of the blade includes the flat surface and the inclined surface having the chamfered shape, thus providing strength and the like to the end. The flat surface, which is positioned proximate to the pressure partition wall, prevents the fluid from leaking through a gap with the pressure partition wall, and at the same time directs leaked fluid to an inner portion of the blade chamber along the inclined surface. Thereby, cavitation is prevented and noise is reduced.

At the end portion of the pressure chamber, the second pressure surface has the flat surface connected to the pressure surface and provided in parallel with the outer end rotation trajectory of the blade, and the curved surface connecting the flat surface and the pressure end portion. The shape allows bubbles in the fluid to move along the flat surface to the curved surface, and prevents the fluid from being stirred vigorously at the boundary of the pressure partition wall, which occurs in the conventional pump, and from moving to the pressure partition wall side, thus enabling quick discharge from the outlet and improvement in performance of mixing and discharging air.

The pressure end portion includes the outer pressure end portion provided in substantially the radius direction, and the inner pressure end portion provided in the tangential direction from substantially the front side base portion of the second pressure surface. The shape allows the fluid to sequentially move along the inner pressure end portion on the second pressure surface to the outer periphery side, and thereby efficiently discharges the fluid from the outlet while increasing the fluid pressure from the outer pressure end portion.

DESCRIPTION OF THE NUMERICAL CHARACTERS

Figure 1:
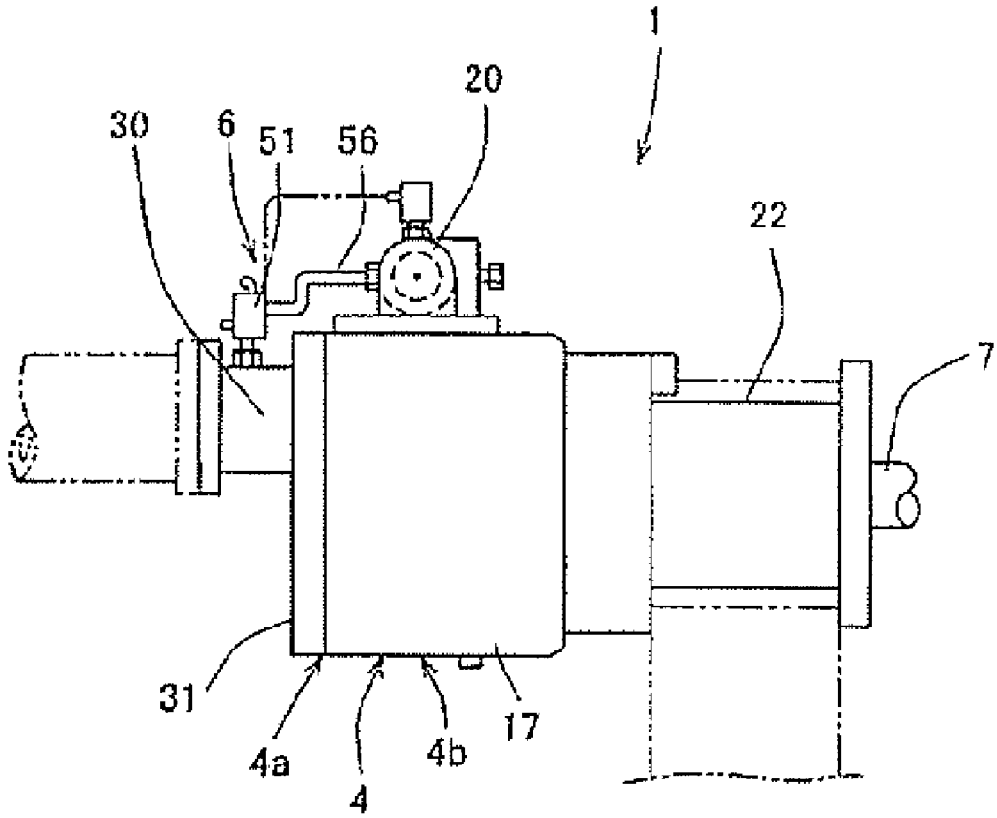
FIG. 1 is a front view of a pressurizing centrifugal pump according to the present invention.

1. Pump (Pressurizing centrifugal pump)
2. Inlet
3. Outlet
4. Case
4*a*. Pressure case
4*b*. Impeller case
5. Impeller
5*a*. Blade surface
5*b*. Blade outer surface
5*c*. Flat surface
5*d*. Blade rear surface
5*e*. Inclined surface
9. Pump chamber
16. Pressure portion
19. Blade
26. Blade plate
27. Blade chamber
27*a*. Boss portion
29. Partition wall
33. Pressure chamber
35. Pressure partition wall
36. Pressure surface
36*a*. Second pressure surface
37. Pressure end portion
37*a*. Outer pressure end portion
37*b*. Inner pressure end portion
39. Pressure surface for direction change
40. Flat surface
41. Curved surface
α. Blade outer forward inclination angle
θ. Blade forward inclination angle

DETAILED DESCRIPTION OF THE PREFERRED EMBODIMENT

An embodiment of the present invention is explained with reference to the drawings. In FIGS. 1 to 4, a pressurized centrifugal pump 1, which has a structure for mixing gas and the like, includes a drum-shaped case 4 provided with an inlet 2 and an outlet 3; an impeller 5 rotatably supported in the case 4; and a gas supply apparatus 6 that supplies gas, such as air and the like, into the case 4; and the like.

Figure 2:
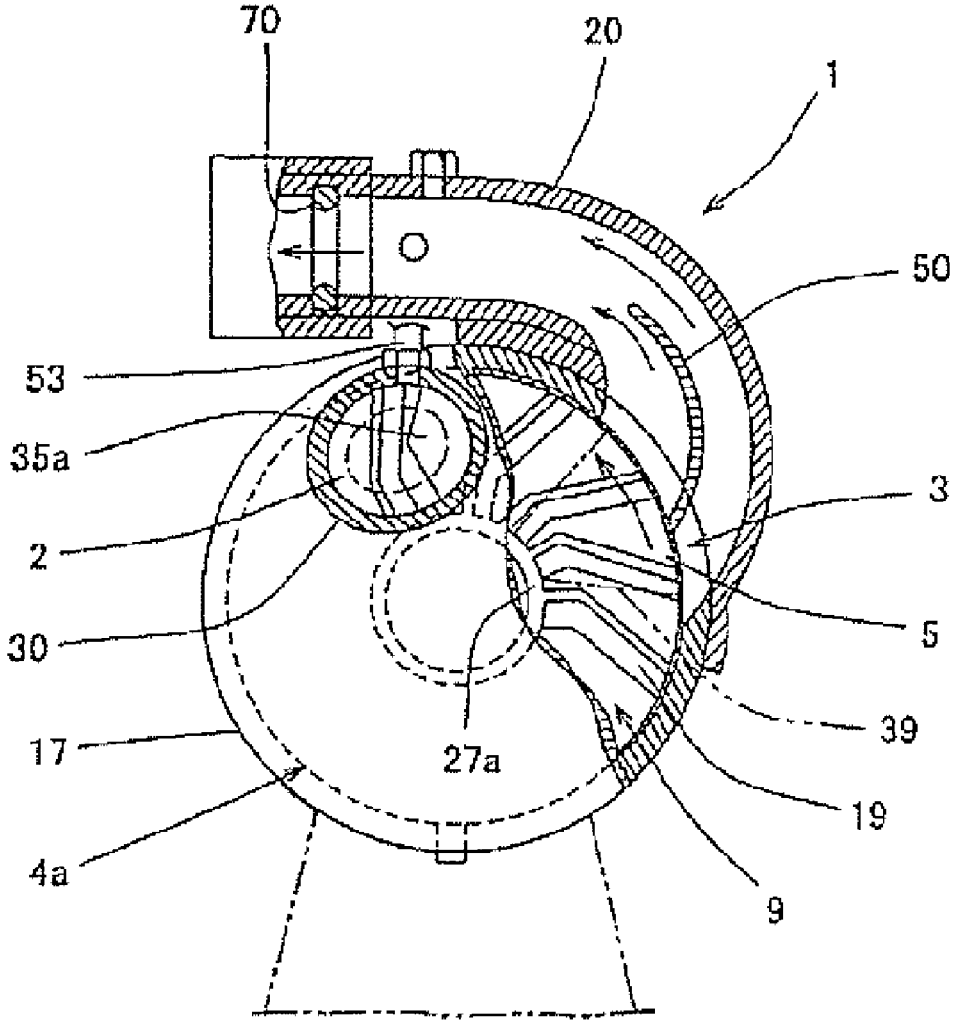
FIG. 2 is a left side view of the pump of FIG. 1, which is partially omitted.
Figure 5:
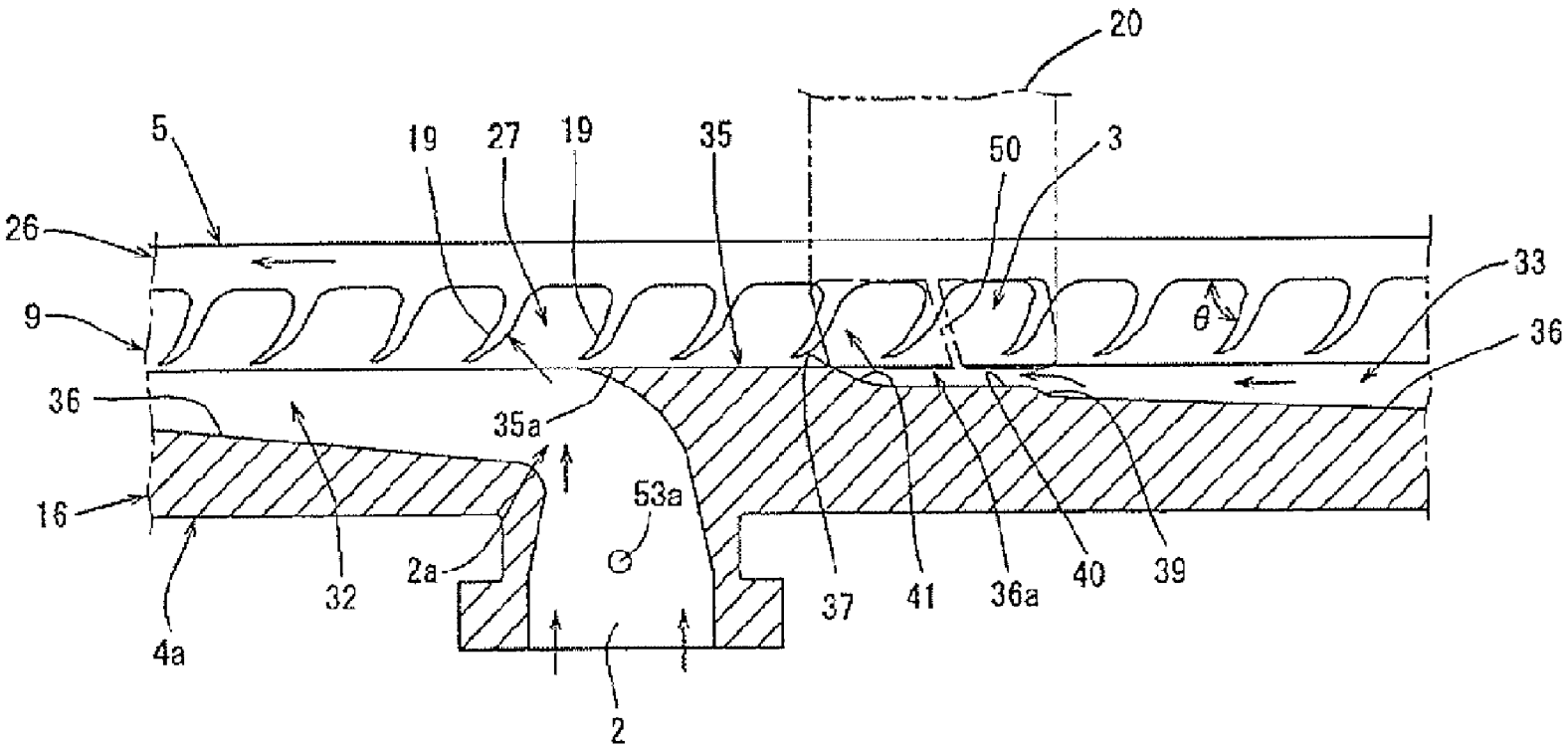
FIG. 5 is a developed cross-sectional view illustrating a developed structure of the pump chamber.

In the pump 1, one side of a pump shaft 7 is driven from a motor side so as to rotate the impeller 5 in a direction of an arrow shown in FIGS. 2 and 5. Thereby, the pump 1 sucks from the inlet 2 to a pump chamber 9 in the case 4, desired fluid, such as water, oil, and the like; desired gas, such as air, gas, and the like; and powder, such as a medical agent and the like. The pump 1 then applies pressure and energy as stirring and mixing the gas and the like into the fluid, and discharges the mixed fluid from the outlet 3.

Embodiment

Described below are a detailed structure, a function, and the like of each component. In the embodiment, water is used as fluid, and air as gas to be mixed. The case 4 shown in the drawings includes a pressure case 4*a* having the inlet 2 and an impeller case 4*b* having the outlet 3, which are separately provided and demountably connected as a horizontally positioned pair.

A ring-shaped sealing member 10, an antiwear member 11, and the like are mounted to a joint and an opposing portion of the pressure case 4*a* and the impeller case 4*b*. Fittings 13, such as a mounting screw and the like, secure a plurality of positions in a peripheral direction, so as to constitute the pump chamber 9.

A peripheral wall 17 is integrally provided on an outer periphery of a disk-shaped side wall 15 of the impeller case 4*b*. The peripheral wall 17 has a width that the impeller 5 and a pressure portion 16 (hereinafter described) of the pressure case 4*a* fit therein. The peripheral wall 17 has a hole of the outlet 3 that has a predetermined length covering a plurality of blades 19 in a predetermined portion opposite to a blade width of the impeller 5. A discharge tube 20 curved in a direction of fluid discharge is integrally connected to the outlet 3.

Support potions 21 and 22 are integrally connected to an outer side of the side wall 15, so as to rotatably support the pump shaft 7. The support portion 22 positions and axially supports the pump shaft 7 to a center portion of the pump chamber 9 with left and right metal portions 23. A sealing plate 23*a* is provided on a side surface of the metal portion 23; a mechanical seal 23*b* is provided; and a drain hole 24 is used to discharge leaked fluid.

The impeller 5 drilled with the plurality of blades 19 is demountably fixed to a shaft end of the pump shaft 7 in the pump chamber 9, with a mounting structure 25 that includes a mounting screw, a nut, and the like. A second side surface of a blade plate 26 from which the blades 19 protrude is positioned proximate to the side wall 15. A narrow gap is provided between the blades 19 and the peripheral wall 17.

As shown in FIGS. 2 and 5, a tubular boss portion 27*a*, which also serves as a mounting member to the pump shaft 7, is integrally provided from a center portion of the disk-shaped blade plate 26 that serves as a blade side wall of the impeller 5.

The blades 19 protrude radially from the blade plate 26 and the boss portion 27*a*, each having a predetermined spacing. A space provided by each of the blades 19, the blade plate 26, and the boss portion 27*a* constitutes a blade chamber 27 that contains the fluid.

A side end of the boss portion 27*a* and the blade 19 of the impeller 5 is configured to have substantially a same height. When mounted to the impeller case 4*b*, an end surface of the boss portion 27*a* is positioned proximate to an end surface of a planar partition wall 29 provided at a center portion of the pressure case 4*a* hereinafter described. The antiwear member 11 is provided between the boss portion 27*a* and the partition wall 29 for shielding. A plurality of through-holes 26*a* are provided on suitable positions on the blade plate 26. The through-holes 26*a* allow the fluid in the blade chambers 27 to move to the mechanical seal 23*b* side.

As shown in FIGS. 5 and 9 to 11, the blades 19 of the impeller 5 are provided on a first side surface of the disk-shaped blade plate 26, protruding in a radial direction from the boss portion 27*a* toward an upstream side of a rotation direction of the impeller (hereinafter simply referred to as the upstream side). The blade 19 has a bent shape backwardly inclined at a mid-portion of a length of a planar blade piece from a side view. Further, a blade surface 5*a* is provided with a blade forward inclination angle (an intake angle) θ and is inclined toward a downstream side of the rotation direction of the impeller (hereinafter simply referred to as the downstream direction), so that an outer side surface (a plate thickness end) of the blade 19 positioned on the pressure case 4*a* side moves ahead of a blade plate base portion side.

The blade shape allows easy intake of the fluid from the inlet 2 as the impeller 5 rotates, and retains the fluid in the blade chamber 27. When each of the blades 19 reaches the outlet 3 portion, the backwardly inclined blade shape kicks and pushes the fluid in the blade chamber 27 while applying a centrifugal force, thus increasing a flow pressure in a centrifugal direction and improving discharge efficiency.

Figure 9:
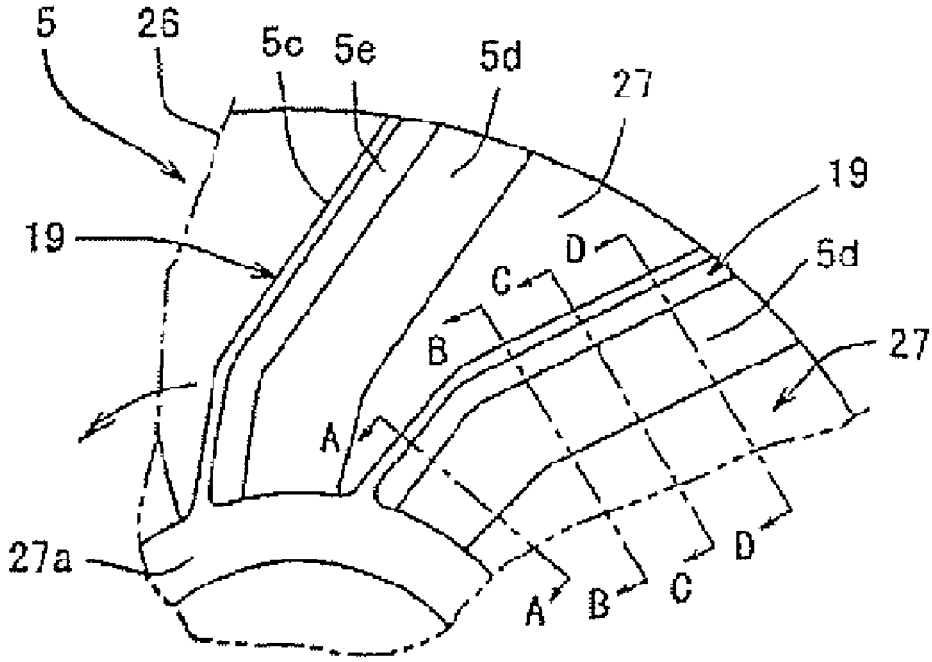
FIG. 9 is a front view of an impeller illustrating a blade shape, which is partially enlarged.
Figure 10:
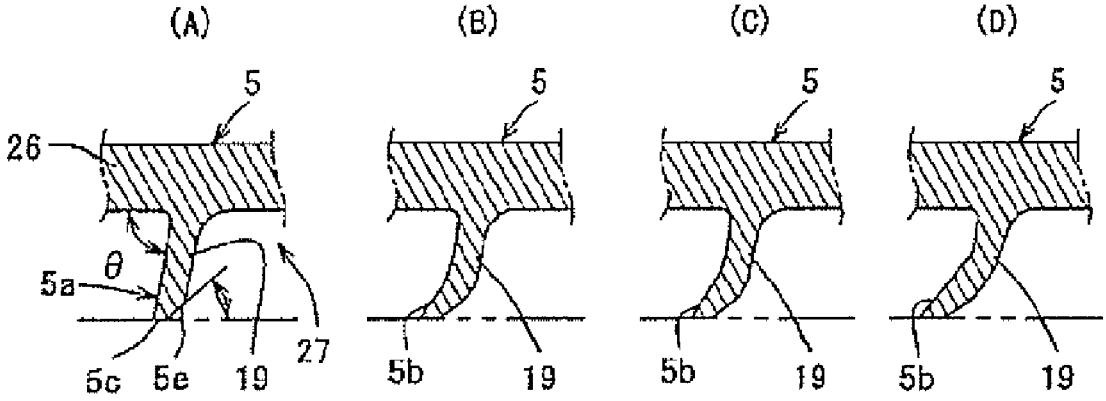
FIG. 10A is a cross-sectional view illustrating a part of the blade shape along line A-A of FIG. 9.
FIG. 10B is a cross-sectional view illustrating a part of the blade shape along line B-B of FIG. 9.
FIG. 10C is a cross-sectional view illustrating a part of the blade shape along line C-C of FIG. 9.
FIG. 10D is a cross-sectional view illustrating a part of the blade shape along line D-D of FIG. 9.

Further, the blade 19 shown in FIG. 9 has a cross-sectional shape at each position from a base portion side to an end portion side as shown in FIG. 10, thus improving pumping efficiency, blade endurance, and noise from the pump.

More specifically, the blade 19 has the blade surface 5*a*, which is a front surface (a front side) of the blade 19, protruding from the blade plate 26 having a gentle blade forward inclination angle θ of about 70 degrees from a plain view. Further, the blade 19 has a blade outer surface 5*b*, which is an outer portion from a mid-portion of the blade surface 5*a* for about one third to a half from a front view, provided with a bent shape having a blade outer forward inclination angle (an outer intake angle) α of about 50 degrees, which is steeper than the blade forward inclination angle θ.

The blade 19 of the embodiment has the base portion, which is provided proximate to the boss portion 27*a*, having a flat shape with no bending or a slightly bent shape from a cross-sectional view as shown in FIGS. 9 and 10A. In the mid-portion of the blade, a width of the blade outer surface 5*b* bent toward the outer side of the blade surface 5*a* is wider toward the outer periphery side than the boss portion 27*a* side from a cross-sectional view as shown in FIGS. 10B to 10D. Thereby, the blade outer surface 5*b* has an inverted triangle shape from a front view, which is inwardly inclined from the boss portion 27*a* side to the outer periphery side having a bending point P.

When 12 pieces of the blades 10 having the above-described shape and a plate thickness of 3 mm are provided having an even spacing and standing on the blade plate 26 having an outer peripheral radius of 125 mm and the boss portion 27*a* having a radius of 55 mm, for example, the spacing of the neighboring blades 19 is about 10 mm on the base portion. Therefore, preventing the bending of the blade 19 on the blade base portion side as shown in 10A does not narrow the spacing on the base portion, thus not obstructing fluid inflow to the base portion side in the blade chamber 27 and not reducing the fluid capacity.

Further, the blade outer surface 5*b* is wider toward the outer periphery so as to increase an intake amount, and thereby the blade 19 takes in the fluid in accordance with the blade spacing that expands so as to increase the fluid capacity in the blade chamber 27. The blade outer surface 5*b*, which is the outer portion of the blade surface 5*a* having the blade forward inclination angle θ, has the blade outer forward inclination angle α and serves as an intake edge. Thereby, the blade outer surface 5*b* prevents the fluid taken into the blade chamber 27 from flowing out to the side. Then, the blade outer surface 5*b* provides the fluid with directivity while keeping a fluid pressure in the blade chamber 27 high, and efficiently discharges the fluid toward the outlet 3.

Figure 11:
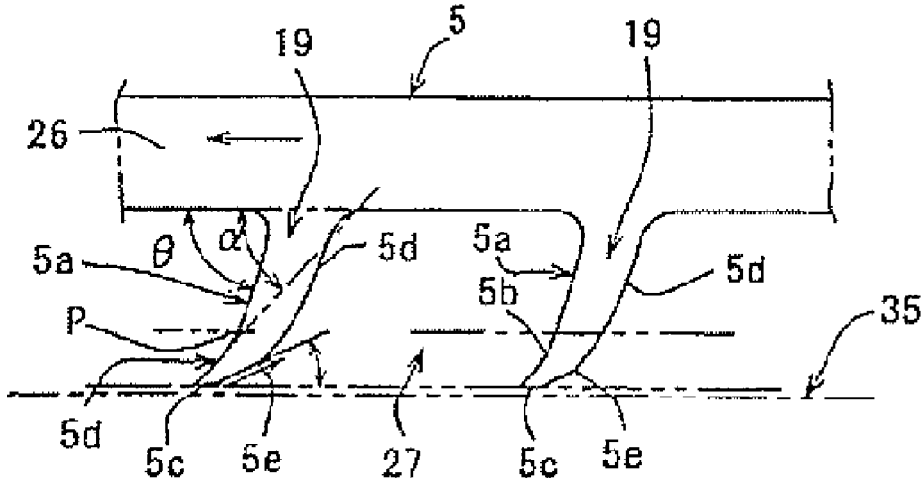
FIG. 11 is a plain view illustrating the shape and function of the blade.

Further, as shown in FIG. 11, a thickness of the blade outer end of the blade 19 includes a flat surface 5*c* and an inclined surface 5*e*. The flat surface 5*c* is provided continuing from the blade outer surface 5*b* and positioned proximate in parallel to a pressure partition wail 35 hereinafter described. The inclined surface 5*e* having a chamfered shape reaches a blade rear surface 5*d*. When the blade 19 has a plate thickness of about 3 mm, for example, it is preferable that the inclined surface 5*e* be provided while the flat surface 5*c* has a width of about 1 mm. Further, the surface of the blade 19 is treated with an antiwear material, such as titanium, and a surface smoothing material, as required.

The blade 19 having the above-described outer end shape has thickness provided by the flat surface 5*c* and has no sharp outer end. Thereby, the blade 19 having strength and antiwear performance can be positioned proximate to the pressure partition wall 35, thus preventing leakage of the fluid, gas, and the like from a portion between the outer end of the blade 19 and the pressure partition wall 35.

Further, a small amount the fluid gushing from the portion between the flat surface 5*c* of blade 19 and the pressure partition wall 35 as the impeller 5 rotates, does not cause large turbulence along the inclined surface 5*e* and is directed into the blade chamber 27 in a subsequent position as being further pressured. The conventional pump, which does not have the inclined surface 5*e* on the flat surface 5*c*, causes severe turbulence in the subsequent blade chamber 27 due to leaked fluid and thus generates noise. The noise is significantly reduced.

Figure 3:
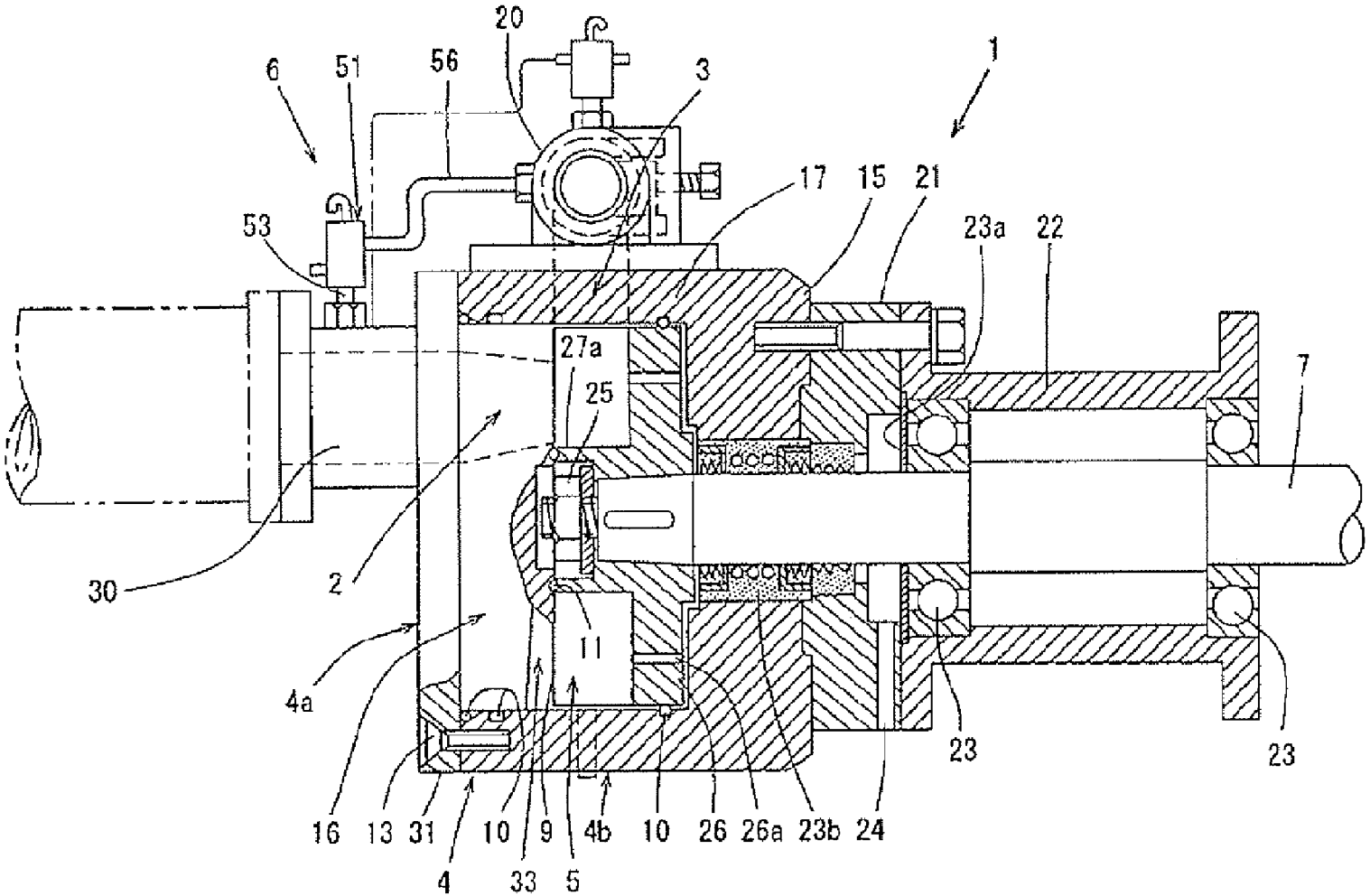
FIG. 3 is a cross-sectional view illustrating an internal structure of a pump chamber of FIG. 1.
Figure 4:
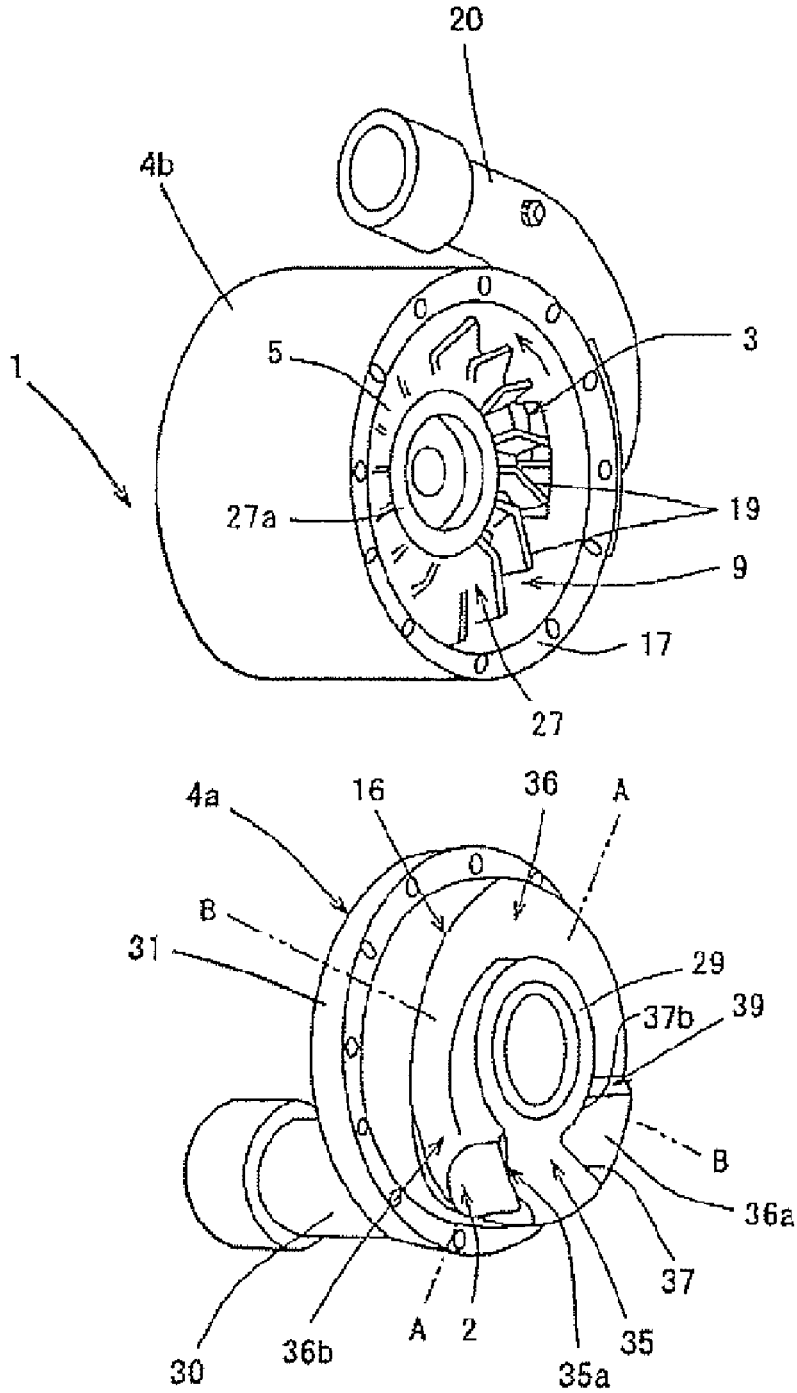
FIG. 4 is an exploded perspective view illustrating a structure of a case of FIG. 1.

Described below is the pressure case 4*a* with reference to FIGS. 3 to 5. The pressure case 4*a* is integrally provided with a case lid 31 having a suction tube 30 and the pressure portion 16. The pressure portion 16 is inserted and fit to an opening of the impeller case 4*b* to which the impeller 5 is mounted. The pressure case 4*a* and the impeller case 4*b* are secured with the fittings 13 so as to close the case 4. The structure forms the pump chamber (the pressure chamber) 9 between the pressure portion 16 and the impeller 5, wherein the fluid sucked from the inlet 2 is pressured via the impeller 5 and discharged from the outlet 3.

More specifically, as shown in FIG. 5, the pump chamber 9 includes a suction chamber 32 that facilitates suction of the fluid, and the pressure chamber 33 that connects to the suction chamber 32 and pressures the fluid. Provided between an end of the pressure chamber 33 and the inlet 2 is the pressure partition wall 35 that has a planar shape and that extends from the partition wall 29. The pressure partition wall 35, which is provided proximate to the side surface of the plurality of blades 19, prevents the leakage of the fluid in the blade chambers 27. Thereby, the suction chamber 32, the pressure chamber 33, and the pressure partition wall 35 are provided continuously around the partition wall 29 that opposes the end surface of the boss portion 27*a* of the impeller 5.

Further, a pressure surface 36, which is a smoothly inclined surface stretching from the inlet 2 side to the pressure partition wall 35, forms the pressure chamber 33 having a converged shape and provided gradually proximate from the suction chamber 32 side to the blades 19. In the structure, the fluid sucked from the inlet 2 into the pump chamber 9 is gradually pressured by the plurality of blades 19 through the pressure chamber 33 having a long channel while the fluid is taken in and retained in each of the blade chambers 27 as the impeller 5 rotates.

The pressure surface 36 is provided up to the pressure end portion 37 positioned at a start portion of the pressure partition wall 35, so that the fluid that moves from the suction chamber 32 to the downstream side is pressured and directed into the blade chamber 27 along the pressure surface 36. Further, the pressure surface 36 pressures the fluid in the pump chamber 9 without causing a sudden pressure change. The fluid, which is pressured to a highest level in the pressure end portion 37, is efficiently pushed out from the outlet 3.

As shown in FIG. 5, the pressure surface 36 of the present embodiment is provided with a pressure surface for direction change 39 having a stepped shape and positioned proximate and opposite to a start portion of the outlet 3 on the upstream side of the pressure end portion 37. The pressure surface for direction change 39 facilitates change of the flow of the pressured fluid to be directed toward the blade chamber 27. A second pressure surface 36*a* is provided between the pressure surface for direction change 39 and the pressure end portion 37.

It is preferable that the pressure surface for direction change 39 be positioned proximate to the downstream side of the start portion of the outlet 3 on the upstream side of the pressure end portion 37. The pressure surface for direction change 39 thus changes the flow of the fluid in the pressure chamber 33 from immediately before the second pressure surface 36*a* to the outlet 3 side via the blade chamber 27. Thereby, the fluid is further pressured in a portion where the outlet 3 is positioned in the pump chamber 9, so as to prevent pressure decrease due to discharge. When air is mixed into the fluid, the air bubbles are swiftly pressured and discharged.

The pressure surface for direction change 39 shown in the drawings is a surface backwardly inclined toward the upstream side of the rotation direction of the impeller from the partition wall 29 to the outer side. The pressure surface for direction change 39 is provided crossing the pressure surface 36 in a radius direction. Further, the pressure surface for direction change 39 has an inclined surface or a smoothly curved surface, oriented to the downstream side of the rotation direction from a cross-sectional view in a peripheral direction. A stepped shape is provided from the pressure surface 36 to the blades 19 side, so as to smoothly connect the pressure surface 36 and the second pressure surface 36*a*.

In the structure, the fluid is stirred in the converged pressure chamber 33 by the blades 19, sequentially pressured along the pressure surface 36, and vigorously swirled. When the air is mixed into the pump, fine bubbles form as the mixed air is pressured and swirled. When the fluid and air bubbles move to the downstream side, the shape of the pressure surface for direction change 39 prevents severe contact resistance from occurring in a mid-portion of the pressure surface 36, thus allowing smooth direction change and flow into the blade chamber 27.

Further, in the present embodiment, the second pressure surface 36*a* is provided connecting the flat surface 40 provided on the pressure surface for direction change 39 side and the curved surface 41 provided on the pressure end portion 37 side, from a cross-sectional view in the peripheral direction as shown in FIG. 5. Conventionally, in contrast, a linearly inclined surface connects the surface pressure for direction change 39 and the pressure end portion 37, thus narrowing a space for a second pressure chamber.

More specifically, the flat surface 40 has a planar shape in parallel to a movement trajectory of the end of the blade 19 on the pressure surface for direction change 39 side. Further, the curved surface 41 has a curved shape that smoothly curves from an end of the flat surface 40 to the pressure end portion 37. The structure provides an enclosed space as large as possible for a second pressure chamber, which is provided between the second pressure surface 36*a* and the movement trajectory of the end of the blade 19 and positioned opposite to the outlet 3.

In the structure, the fluid, which flows from the pressure chamber 33 to the second pressure surface 36*a* via the pressure surface for direction change 39, is moved on the flat surface 40 having a large space and is gently directed by the curved surface 41 to the blade 19 side. During the movement, the rotation of the blades 19 substantially evenly discharges the fluid to the outlet 3, which is provided covering the plurality of blades 19.

The conventional pump has the second pressure surface that linearly connects the pressure surface for direction change 39 and the pressure end portion 37 on the inclined surface. Since the fluid that reaches the second pressure surface is suddenly pressured by the inclined surface and forced to the pressure partition wall 35 side, there have been unresolved shortcomings, such as that the pressure convergence and severe turbulence in the portion cause cavitation as the fluid discharges from the outlet 3.

The cavitation tends to cause a loud pump noise, especially when the air-mixed bubble flow is discharged. In the structure of the present embodiment, however, the second pressure surface 36*a* provided with the large space does not suddenly pressure the fluid, and thus solves the above-described problem.

When the air is mixed into the pump chamber 9, the air flowing together with the fluid flows along the pressure surface 36 to the compression end portion 37 in a form of large bubbles. From the mid-portion along the pressure surface 36, however, the large bubbles turn into fine bubbles, as the blade 19 rotates, and mix into the blade chamber 27.

When the fluid mixed with the fine air bubbles is supplied to the outlet 3 opposite to the second pressure surface 36*a*, the bubbles move from the flat surface 40 to the curved surface 41, continue to the outlet 3 through the deep space provided by the flat surface 40 and the curved surface 41, and then surely discharge.

Thus, the structure prevents the conventionally experienced noise, which is associated with a bubble burst and the like that occur as the fluid is vigorously stirred at the boundary between the blades 19 and the pressure partition wall 35, and then leaks and moves to the suction chamber 32 side. The structure also protects the blades 19 from being damaged at an early stage. Further, the structure prevents the air supplied from the gas supply apparatus 6 from being accumulated and stirred in the pump chamber 9 for a long time, and allows quick discharge from the outlet 3, thereby improving the performance of mixing and discharging the air from the pump 1 and preventing cavitation.

In addition, the pressure end portion 37, which is provided at the end portion of the pressure chamber 33 as shown in the drawings, has a length between the partition wall 29 and the cuter periphery that includes the outer pressure end portion 37*a* and the inner pressure end portion 37*b*. Thereby, the fluid and bubbles are smoothly directed for discharge. The structure facilitates discharge of the air early accumulated in the pump and the tube especially at an initial pumping operation, thus contributing to improvement in pump suction efficiency.

More specifically, a length of the outer pressure end portion 37*a* is about a half of a length of the blade 19 and is provided in substantially a radius direction. A length of the inner pressure end portion 37*b* is provided in a front portion of the second pressure surface 36*a* in a tangential direction from the partition wall 29.

Thereby, when the highly pressured fluid reaches the second pressure surface 36*a*, the fluid on the partition wall 29 side (the inner periphery) sequentially moves to the outer periphery along the inner pressure end portion 37*b*; the fluid pressure increases in a rectified state along the outer pressure end portion 37*a*; and the fluid discharges from the outlet 3 as being highly pressured.

When the fluid is directed on the second pressure surface 36*a* and discharged as described above, the bubbles mixed into the fluid on the inner peripheral side also smoothly move from the inner pressure end portion 37*b* to the outer pressure end portion 37*a*. Further, the bubbles are prevented form moving to the pressure partition wall 35 side, thus increasing the discharge efficiency and the pump suction efficiency. The outer pressure end portion 37*a* may continue to the inner pressure end portion 37*b* and be provided radially, as required.

Figure 6:
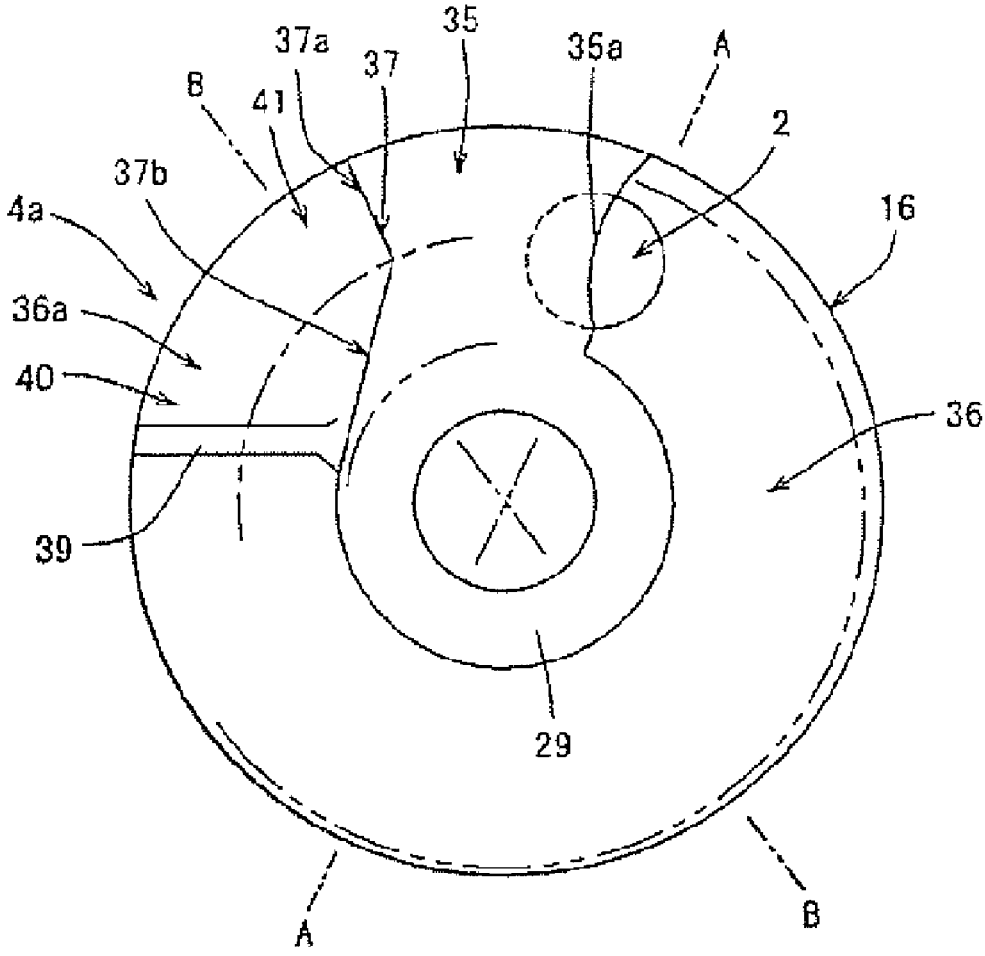
FIG. 6 is a front view illustrating a structure of a pressure case.
Figure 7:
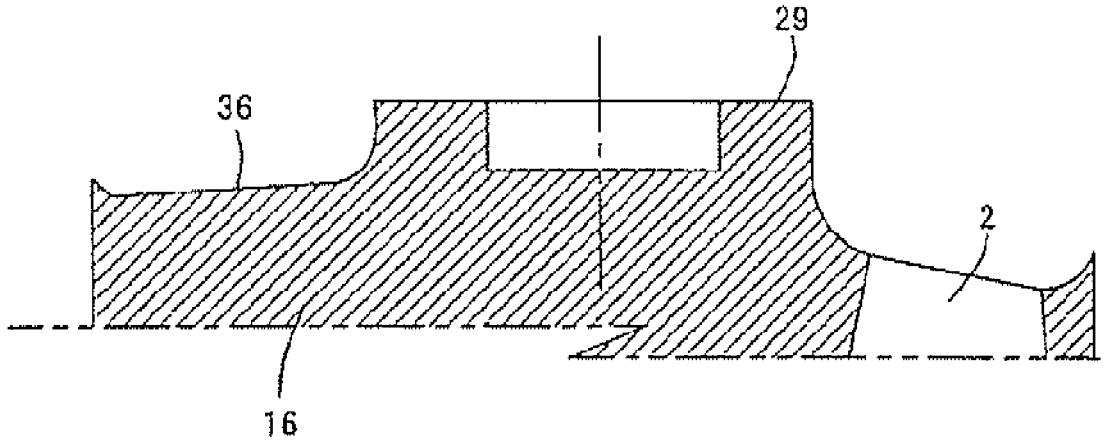
FIG. 7 is a cross-sectional view along line A-A of FIG. 6.
Figure 8:
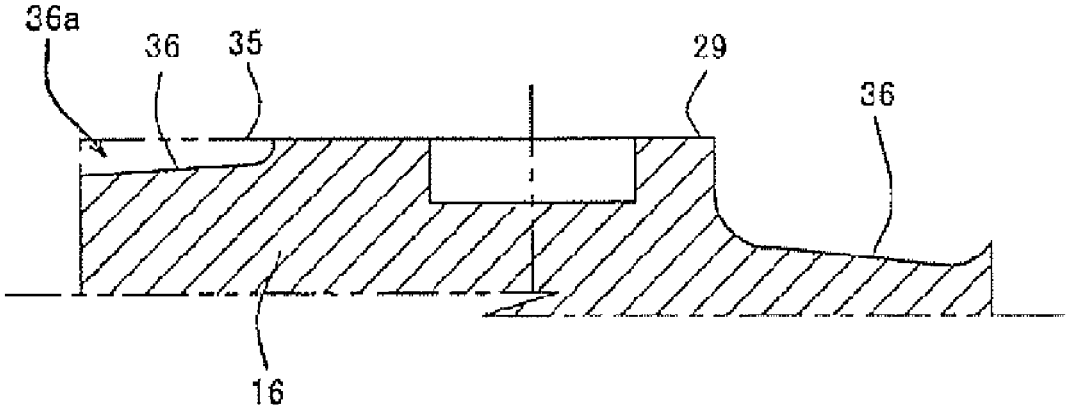
FIG. 8 is a cross-sectional view along line B-B of FIG. 6.

The inlet 2 provided in the pressure case 4*a* is provided as a nozzle hole 2*a* that tapers toward an end. The sucked fluid is pressured and accelerated, and is supplied in the rotation direction as shown with arrows in FIG. 6, by the rear surface of the blade 19 that has the blade forward inclination angle θ and the blade outer forward inclination angle α, thereby increasing the pumping efficiency.

Meanwhile, the outlet 3 provided on the impeller case 4*b* is a portion provided on the end portion side of the pressure chamber 33 and positioned opposite to the second pressure surface 36*a* and the pressure partition wall 35. The outlet 3 is an opening having an elongated shape and provided on the periphery wall 17 of the impeller case 4*b* opposite to a blade width. Provided at a mid-portion in a length direction of the outlet 3 is a planar guide member 50 that directs and discharges the fluid. The guide member 50 is laterally positioned having substantially a reverse angle of the blade forward inclination angle θ of the blade 19 from a plain view. Further, front and rear sides of the outlet 3 are configured to have an inclination in substantially the same direction as the guide member 50.

Described below is the gas supply apparatus 6 with reference to FIGS. 1 to 5. In the gas supply apparatus 6, a gas suction chamber of a gas supply valve 51, which has a publicly known structure, is connected to a mounting hole 53*a* via a connecting tube 53, and a supply control chamber (not shown in the drawings) is connected to the discharge tube 20 via a control tube 56. The structure discharges the fluid from the outlet 3 as the pump 1 operates, transfers discharge pressure of the fluid to the supply control chamber through the control tube 56, and automatically supplies and mixes the air from the gas supply valve 51 into the fluid in the inlet 2 that flows in a suction direction.

Described below are a use, a function, and the like of the above-structured pump 1. First, when the motor rotates and drives the impeller 5, each of the blades 19 takes in and sucks the fluid and air from the inlet 2 into the blade chamber 27, and continuously transfers the fluid into the pump chamber 9 while containing the fluid in each of the blade chambers 27.

The fluid and air bubbles in the pressure chamber 33 are pressured along the pressure surface 36, enter the blade chambers 27 as being further pressured, reach the pressure partition wall 35, and discharge from the outlet 3 as being pressured to the highest level and being applied with a pushing force and a centrifugal force generated by the shape of the pressure surface 36 and the rotation of the blades 19.

In the gas mixing structure of the pump 1, when the pump 1 operates and discharges the fluid from the outlet 3 and thus increases the fluid discharge pressure, the gas supply valve 51 supplies the air to the inlet 2 side and mixes the air into the fluid.

Then, the pump 1 stirs the supplied air using the blades 19 in the converged pressure chamber 33, sequentially pressures the air along the pressure surface 36 and mixes the air into the fluid, forms the fine bubbles and evenly mixes the bubbles into the fluid, and forcefully discharges the fluid.

The pump is thus capable of performing treatments at high efficiency, including rinsing with air mixed fluid, water purification with an aeration process, and other treatments. The gas mixed into the pump 1 is not limited to air, but a variety of gas and particulates may be mixed. Further, desired liquid such as a medical solution, a fire extinguishing solution, a nutrient solution, and the like, may be supplied and mixed, thus enhancing the convenience of use and expanding application of the pump.

What is claimed is:

1. A pressurizing centrifugal pump having:

a drum-shaped case provided with an inlet and an outlet;

an impeller provided with a plurality of blades that have a sweepback angle in a rotation direction and that protrude radially from a boss portion on a side surface of a blade plate;

a pressure portion provided with a pressure surface that faces the blades and that forms a pressure chamber converging from the inlet side to the outlet side, and with a pressure partition wall that is provided proximate to a side surface of the blades and that prevents leakage of fluid in blade chambers; and a pump chamber provided in the drum-shaped case, in which the impeller is provided opposite to the pressure portion; the pump comprising:

a blade surface of the blade provided protruding from the blade plate having a gentle blade forward inclination angle from a plain view; and a blade outer surface, which is an outer portion from a mid-portion of the blade surface, having a bent shape having a blade outer forward inclination angle, which is steeper than the blade forward inclination angle.

2. The pressurizing centrifugal pump according to claim 1, wherein the blade outer surface has a width that is wider toward an outer periphery side of the impeller than the boss portion side thereof, and has a bent shape provided on the blade surface.

3. The pressurizing centrifugal pump according to claim 2, wherein a thickness of an outer end of the blade includes a flat surface and an inclined surface, the flat surface being provided continuing from the blade outer surface side and proximate in parallel to the pressure partition wall, the inclined surface having a chamfered shape and being provided extending from the flat surface to a blade rear surface.

4. The pressurizing centrifugal pump according to claim 1, wherein a second pressure surface includes a flat surface and a curved surface, the second pressure surface being provided extending from a pressure end portion provided on the pressure partition wall at an end portion of the pressure chamber and being positioned opposite to the outlet, the flat surface being connected to the pressure surface and being provided in parallel with an outer end rotation trajectory of the blade, the curved surface connecting the flat surface and the pressure end portion.

5. The pressurizing centrifugal pump according to claim 4, wherein a length of the pressure end portion includes an outer pressure end portion and an inner pressure end portion, the outer pressure end portion having about a half of a length of the blade and being provided in substantially a radius direction, the inner pressure portion being provided in a tangential direction from substantially a front side base portion of the second pressure surface.

6. The pressurizing centrifugal pump according to claim 2, wherein a second pressure surface includes a flat surface and a curved surface, the second pressure surface being provided extending from a pressure end portion provided on the pressure partition wall at an end portion of the pressure chamber and being positioned opposite to the outlet, the flat surface being connected to the pressure surface and being provided in parallel with an outer end rotation trajectory of the blade, the curved surface connecting the flat surface and the pressure end portion.

7. The pressurizing centrifugal pump according to claim 3, wherein a second pressure surface includes a flat surface and a curved surface, the second pressure surface being provided extending from a pressure end portion provided on the pressure partition wall at an end portion of the pressure chamber and being positioned opposite to the outlet, the flat surface being connected to the pressure surface and being provided in parallel with an outer end rotation trajectory of the blade, the curved surface connecting the flat surface and the pressure end portion.

8. The pressurizing centrifugal pump according to claim 6, wherein a length of the pressure end portion includes an outer pressure end portion and an inner pressure end portion, the outer pressure end portion having about a half of a length of the blade and being provided in substantially a radius direction, the inner pressure portion being provided in a tangential direction from substantially a front side base portion of the second pressure surface.

9. The pressurizing centrifugal pump according to claim 7, wherein a length of the pressure end portion includes an outer pressure end portion and an inner pressure end portion, the outer pressure end portion having about a half of a length of the blade and being provided in substantially a radius direction, the inner pressure portion being provided in a tangential direction from substantially a front side base portion of the second pressure surface.

* * * * *